US011705056B2

(12) United States Patent
Noh et al.

(10) Patent No.: US 11,705,056 B2
(45) Date of Patent: Jul. 18, 2023

(54) ELECTROLUMINESCENCE DISPLAY APPARATUS

(71) Applicant: LG Display Co., Ltd., Seoul (KR)

(72) Inventors: Dong In Noh, Gumi-si (KR); Young Ho Kim, Paju-si (KR); Yang Seok Jeong, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/386,905

(22) Filed: Jul. 28, 2021

(65) Prior Publication Data

US 2022/0036812 A1 Feb. 3, 2022

(30) Foreign Application Priority Data

Jul. 28, 2020 (KR) ..... 10-2020-0093993

(51) Int. Cl.
*G09G 3/32* (2016.01)

(52) U.S. Cl.
CPC ..... *G09G 3/32* (2013.01); *G09G 2310/0243* (2013.01); *G09G 2310/0267* (2013.01); *G09G 2310/061* (2013.01); *G09G 2310/08* (2013.01); *G09G 2320/0233* (2013.01); *G09G 2360/12* (2013.01)

(58) Field of Classification Search
CPC ... G09G 3/32–3291; G09G 2300/0809; G09G 2300/0819; G09G 2300/0861; G09G 2310/0243; G09G 2310/0267–0275; G09G 2310/06–063; G09G 2310/08; G09G 2320/0219; G09G 2320/0223; G09G 2320/0233; G09G 2320/0242; G09G 2320/0252; G09G 2320/029; G09G 2320/0295; G09G 2320/0606–062; G09G 2320/0693; G09G 2350/00; G09G 2360/12
See application file for complete search history.

(56) References Cited

U.S. PATENT DOCUMENTS

2005/0285834 A1* 12/2005 Nakata ..... G09G 3/3696 345/88
2011/0157244 A1* 6/2011 Nakano ..... G09G 3/3413 345/690
2013/0127692 A1* 5/2013 Yoon ..... G09G 3/3258 345/80

(Continued)

FOREIGN PATENT DOCUMENTS

KR 10-2018-0020359 A 2/2018
KR 10-2019-0140760 A 12/2019
KR 10-2020-0030853 A 3/2020

*Primary Examiner* — Nathan Danielsen
(74) *Attorney, Agent, or Firm* — Morgan, Lewis & Bockius LLP

(57) ABSTRACT

An electroluminescence display apparatus includes a display panel, including a pixel including a driving element and a light emitting device, and a panel driving circuit supplying the pixel with a first data voltage for a display driving operation and a display scan signal synchronized with the first data voltage in a vertical active period succeeding a first vertical blank period and maintaining the first data voltage in the pixel during a second vertical blank period succeeding the vertical active period, wherein a length of the first vertical blank period is fixed regardless of a variation of a frame frequency, and a length of the second vertical blank period varies based on the variation of the frame frequency.

17 Claims, 9 Drawing Sheets

(56) References Cited

U.S. PATENT DOCUMENTS

| | | | | |
|---|---|---|---|---|
| 2016/0351095 | A1* | 12/2016 | Tani | G09G 3/3283 |
| 2018/0053462 | A1 | 2/2018 | Bae et al. | |
| 2018/0338112 | A1* | 11/2018 | Yanaba | G09G 5/005 |
| 2019/0378459 | A1 | 12/2019 | Kim et al. | |

* cited by examiner

SCAN(n)
VSP1
VSP2
VSP
VSP1
VSP2
VSP
VSP2
n2
n3
n1
n2
n3
n1
VSEL2
VSEL1
VSEL2
VSEL1
VSEL2
VSEL1
VSEL2
VSEL1
STME
STME
STME
STME
STME1
STME2
STME1 + STME2
STME
STME
STME
STME
STME

ELECTROLUMINESCENCE DISPLAY APPARATUS

This application claims the benefit of Korean Patent Application No. 10-2020-0093993, filed on Jul. 28, 2020, which is hereby incorporated by reference as if fully set forth herein.

FIELD OF THE TECHNOLOGY

The present disclosure relates to an electroluminescence display apparatus.

BACKGROUND ART

Electroluminescence display apparatuses are categorized into inorganic light emitting display apparatuses and electroluminescence display apparatuses on the basis of a material of a light emitting layer. Each of a plurality of pixels of the electroluminescence display apparatuses includes a light emitting device self-emitting light and controls the amount of light emitted by the light emitting device by using a data voltage based on a gray level of image data to adjust luminance.

Electroluminescence display apparatuses use external compensation technology so as to increase image quality. The external compensation technology senses a pixel voltage or current based on an electrical characteristic of a pixel and modulates data of an input image on the basis of a sensed result, thereby compensating for an electrical characteristic deviation between pixels.

However, in conventional external compensation technology, when a frame frequency varies rapidly, a luminance deviation between a compensation pixel and a non-compensation pixel may increase, and due to this, a position of a compensation pixel in a display panel may be recognized by a user.

SUMMARY

To overcome the aforementioned problem of the related art, the present disclosure may provide an electroluminescence display apparatus which disables a user to recognize a position of a compensation pixel even when a frame frequency varies based on an input image in a process of compensating for an electrical characteristic deviation between pixels on the basis of an external compensation method.

To achieve these objects and other advantages and in accordance with the purpose of the disclosure, as embodied and broadly described herein, an electroluminescence display apparatus includes a display panel, including a pixel including a driving element and a light emitting device, and a panel driving circuit supplying the pixel with a first data voltage for a display driving operation and a display scan signal synchronized with the first data voltage in a vertical active period succeeding a first vertical blank period and maintaining the first data voltage in the pixel during a second vertical blank period succeeding the vertical active period, wherein a length of the first vertical blank period is fixed regardless of a variation of a frame frequency, and a length of the second vertical blank period varies based on the variation of the frame frequency.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION OF THE DISCLOSURE

Figure 1:
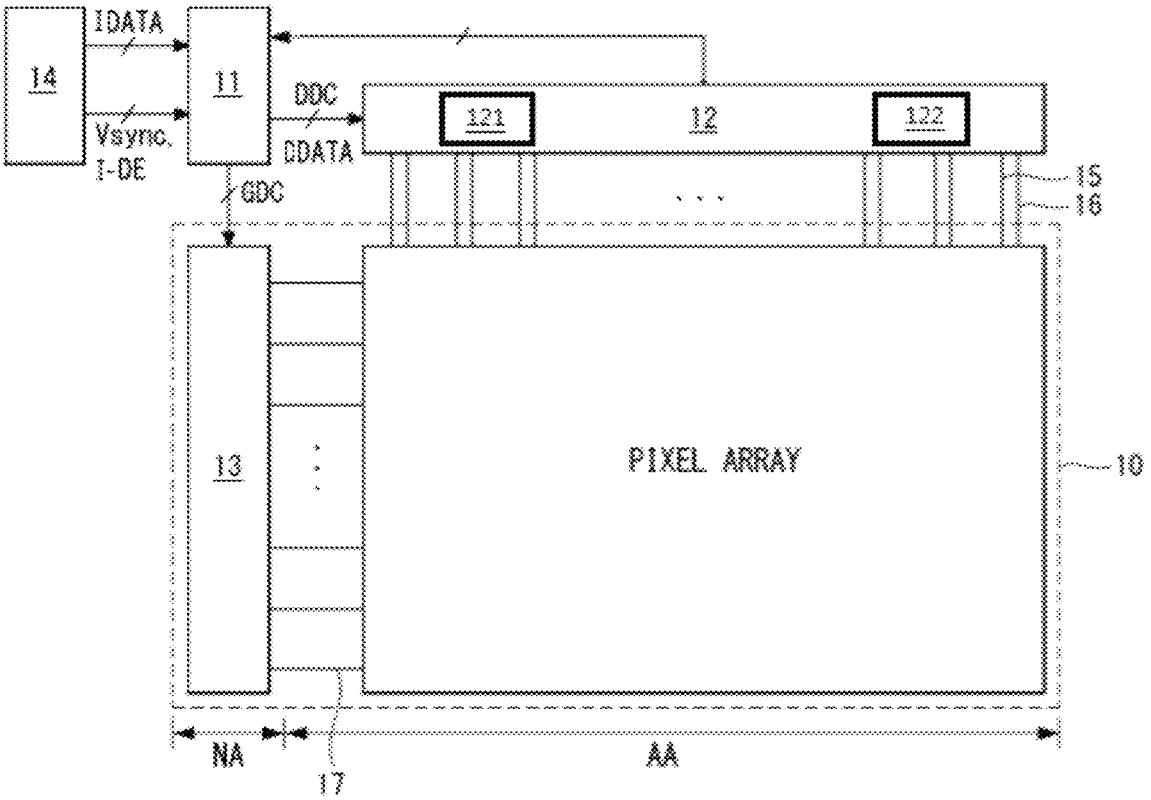
FIG. 1 is a diagram illustrating an electroluminescence display apparatus according to an embodiment of the present disclosure.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Furthermore, the present disclosure is only defined by scopes of claims.

The shapes, sizes, ratios, angles, numbers and the like disclosed in the drawings for description of various embodiments of the present disclosure to describe embodiments of the present disclosure are merely exemplary and the present disclosure is not limited thereto. Like reference numerals refer to like elements throughout. Throughout this specification, the same elements are denoted by the same reference numerals. As used herein, the terms "comprise", "having," "including" and the like suggest that other parts can be added unless the term "only" is used. As used herein, the singular forms "a", "an", and "the" are intended to include the plural forms as well, unless context clearly indicates otherwise.

Elements in various embodiments of the present disclosure are to be interpreted as including margins of error even without explicit statements.

In describing a position relationship, for example, when a position relation between two parts is described as "on~", "over~", "under~", and "next~", one or more other parts may be disposed between the two parts unless "just" or "direct" is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

Like reference numerals refer to like elements throughout.

In the specification, a gate driving circuit provided on a substrate of a display panel may be implemented with a thin film transistor (TFT) having an n-type metal oxide semiconductor field effect transistor (MOSFET) structure, but is not limited thereto and may be implemented with a TFT having a p-type MOSFET structure. A TFT may be a three-electrode element which includes a gate, a source, and a drain. The source may be an electrode which supplies a carrier to a transistor. In the TFT, a carrier may start to flow from the source. The drain may be an electrode which enables the carrier to flow out from the TFT. That is, in a MOSFET, the carrier flows from the source to the drain. In the n-type TFT (NMOS), because a carrier is an electron, a source voltage may have a lower voltage than a drain voltage so that the electron flows from the source to the drain. In the n-type TFT, because the electron flows from the source to the drain, a current may flow from the drain to the source. On the other hand, in the p-type TFT (PMOS), because a carrier is a hole, a source voltage may be higher than a drain voltage so that the hole flows from the source to the drain. In the p-type TFT, because the hole flows from the source to the drain, a current may flow from the source to the drain. It should be noted that a source and a drain of a MOSFET are not fixed but switch therebetween. For example, the source and the drain of the MOSFET may switch therebetween. Therefore, in describing embodiments of the present disclosure, one of a source and a drain will be described as a first electrode, and the other of the source and the drain will be described as a second electrode.

In the following description, when the detailed description of the relevant known function or configuration is determined to unnecessarily obscure the important point of the present disclosure, the detailed description will be omitted. Hereinafter, embodiments of the present disclosure will be described in detail with reference to the accompanying drawings.

Figure 2:
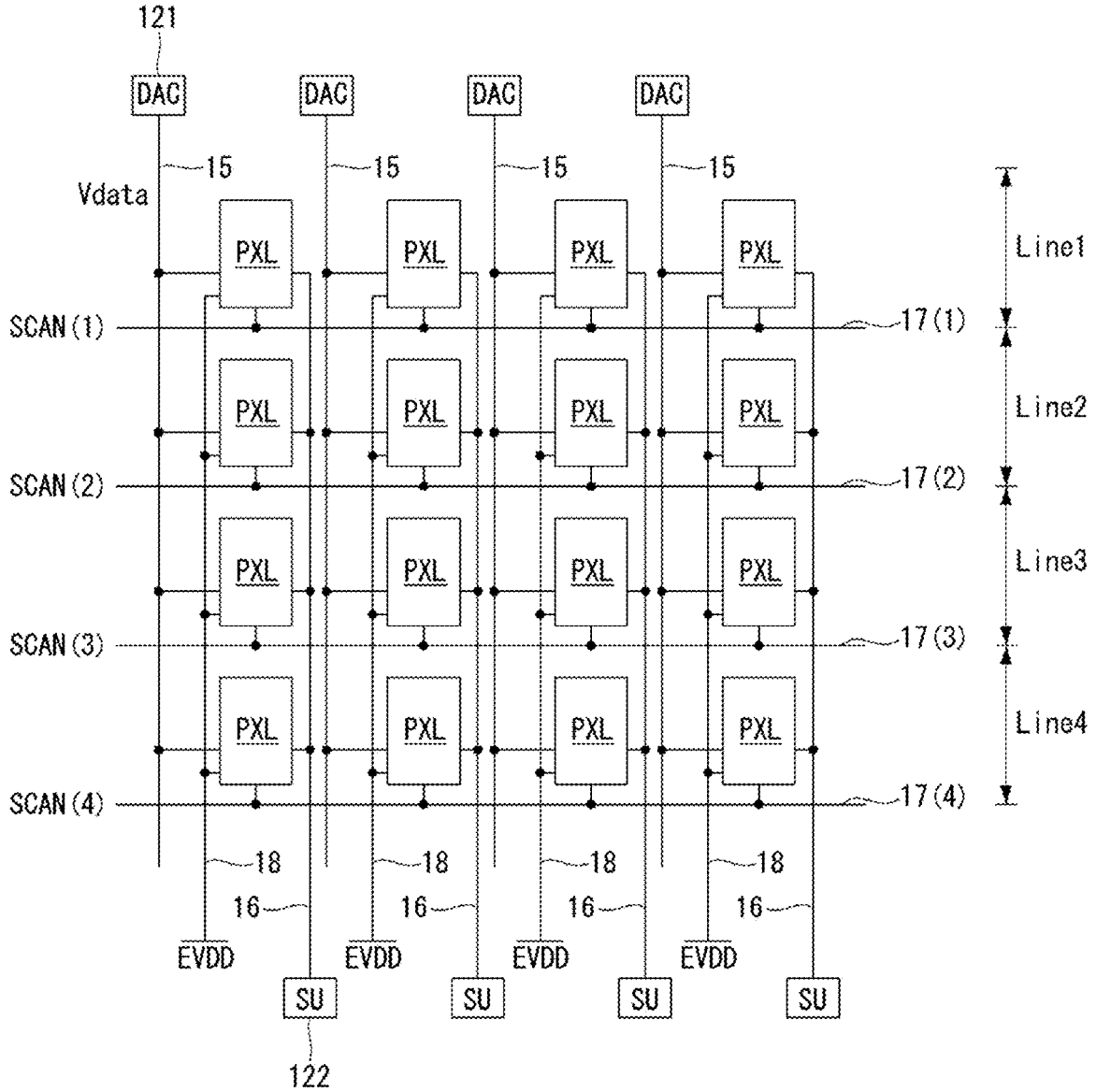
FIG. 2 is a diagram illustrating a pixel array included in the electroluminescence display apparatus of FIG. 1.
Figure 3:
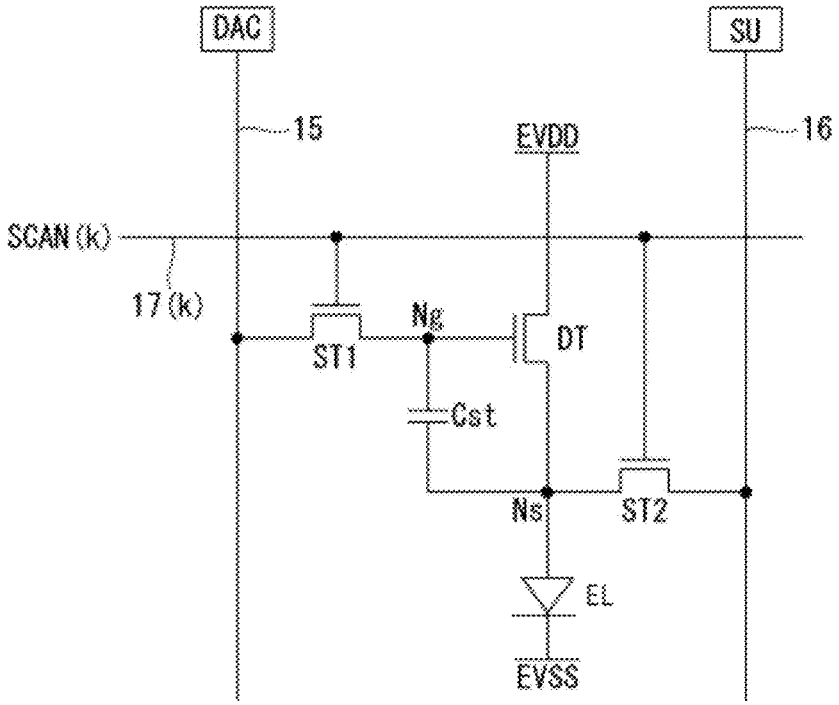
FIG. 3 is an equivalent circuit diagram of a pixel included in the pixel array of FIG. 2.

FIG. 1 is a diagram illustrating an electroluminescence display apparatus according to an embodiment of the present disclosure. FIG. 2 is a diagram illustrating a pixel array included in the electroluminescence display apparatus of FIG. 1. FIG. 3 is an equivalent circuit diagram of a pixel included in the pixel array of FIG. 2.

Referring to FIGS. 1 to 3, the electroluminescence display apparatus according to an embodiment of the present disclosure may include a display panel 10, a timing controller 11, a plurality of panel driving circuits 121 and 13, and a sensing circuit (SU) 122. The panel driving circuits 121 and 13 may include a digital-to-analog converter (DAC) 121, connected to a plurality of data lines 15 of the display panel 10, and a gate driver 13 connected to a plurality of gate lines 17 of the display panel 10. The panel driving circuits 121 and 13 and the sensing circuit 122 may be equipped in a data integrated circuit (IC) 12.

The display panel 10 may include the plurality of data lines 15, a plurality of readout lines 16, and the plurality of gate lines 17. Also, a plurality of pixels PXL may be respectively provided in a plurality of pixel areas defined by intersections of the date lines 15, the readout lines 16, and the gate lines 17. Based on the pixels PXL arranged as a matrix type, a pixel array illustrated in FIG. 2 may be provided in a display area AA of the display panel 10.

In the pixel array, the pixels PXL may be grouped into pixel group lines with respect to one direction. Each of the pixel group lines (Line1 to Line4) may include a plurality of pixels PXL adjacent to one another in an extension direction (or a horizontal direction) of the gate line 17. The pixel group line may denote a set of pixels PXL which are arranged adjacent to one another in one horizontal direction thereof, instead of a physical signal line. Therefore, pixels PXL configuring the same pixel group line may be connected to the same gate line 17. Pixels PXL configuring the same pixel group line may be connected to different data lines 15, but are not limited thereto. Pixels PXL configuring the same pixel group line may be connected to different readout lines 16, but are not limited thereto and a plurality of pixel PXL for realizing different colors may share one readout line 16.

In the pixel array, each of the pixels PXL may be connected to the DAC 121 through the data line 15 and may be connected to the sensing circuit 122 through the readout line 16. The DAC 121 and the sensing circuit 122 may be embedded into the data IC 12, but are not limited thereto. The sensing circuit 122 may be mounted on a control printed circuit board (PCB) (not shown) outside the data IC 12.

In the pixel array, each of the pixels PXL may be connected to a high level pixel power EVDD through a high level power line 18. Also, each of the pixels PXL may be connected to the gate driver 13 through gate lines 17(1) to 17(4).

In the pixel array, the pixels PXL may include a plurality of pixels for implementing a first color, a plurality of pixels for implementing a second color, and a plurality of pixels for implementing a third color, and moreover, may further include a plurality of pixels for implementing a fourth color. The first to fourth colors may each be one color selected from among red, green, blue, and white.

Each pixel PXL may be implemented as in FIG. 3, but is not limited thereto. One pixel PXL provided in a $k^{th}$ (where k is an integer) pixel group line may include a light emitting device EL, a driving thin film transistor (TFT) DT, a storage capacitor Cst, a first switch TFT ST1, and a second switch TFT ST2. The first switch TFT ST1 and the second switch TFT ST2 may be connected to the same gate line 17(*k*).

The light emitting device EL may emit light on the basis of a pixel current. The light emitting device EL may include an anode electrode connected to a source node Ns, a cathode electrode connected to a low level pixel power EVSS, and an organic or inorganic compound layer disposed between the anode electrode and the cathode electrode. The organic or inorganic compound layer may include a hole injection layer (HIL), a hole transport layer (HTL), an emission layer (EML), an electron transport layer (ETL), and an electron injection layer (EIL). When a voltage applied to the anode electrode is higher than an operating point voltage compared to the low level pixel power EVSS applied to the cathode electrode, the light emitting device EL may be turned on. When the light emitting device EL is turned on, a hole passing through the hole transport layer (HTL) and an electron passing through the electron transport layer (ETL) may move to the emission layer (EML) to generate an exciton, and thus, the emission layer (EML) may emit light.

The driving TFT DT may be a driving element. The driving TFT DT may generate the pixel current flowing in the light emitting device EL, on the basis of a voltage difference between a gate node Ng and a source node Ns thereof. The driving TFT DT may include a gate electrode connected to the gate node Ng, a first electrode connected to the high level pixel power EVDD, and a second electrode connected to the source node Ns. The storage capacitor Cst may be connected between the gate node Ng and the source node Ns and may store a gate-source voltage of the driving TFT DT.

The first switch TFT ST1 may allow a current to flow between the data line 15 and the gate node Ng on the basis of a gate signal SCAN(k) and may apply a data voltage, charged into the data line 15, to the gate node Ng. The first switch TFT ST1 may include a gate electrode connected to the gate line 17(*k*), a first electrode connected to the data line 15, and a second electrode connected to the gate node Ng. The second switch TFT ST2 may allow a current to flow between the readout line 16 and the source node Ns on the basis of the gate signal SCAN(k) and may transfer a voltage of the source node Ns, based on the pixel current, to the readout line 16. The second switch TFT ST2 may include a gate electrode connected to the gate line 17(*k*), a first electrode connected to the source node Ns, and a second electrode connected to the readout line 16.

Such a pixel structure is merely an embodiment, and the technical spirit of the present disclosure is not limited to the pixel structure. It should be noted that the technical spirit of the present disclosure may be applied to various pixel structures for sensing an electrical characteristic (for example, a threshold voltage or electron mobility) of the driving TFT DT.

The timing controller 11 may receive a vertical synchronization signal Vsync, an input data enable signal I-DE, and input image data IDATA, which are synchronized with a variable frame frequency, from the host system 14 through various interface circuits.

In a variable frame frequency environment, a length of a vertical active period may be fixed, and a length of a vertical blank period may vary based on a frame frequency. The vertical blank period may include a first vertical blank period, where a length thereof is fixed, and a second vertical blank period where a length thereof varies. The first vertical blank period may be set based on a highest frame frequency within a predetermined range of the variable frame frequency, and thus, may be fixed regardless of a variation of the frame frequency. On the other hand, the second vertical blank period may be set to increase as the frame frequency is lowered within the predetermined range of the variable frame frequency, and thus, may vary based on a variation of the frame frequency.

The timing controller 11 may perform a sensing driving operation during the first vertical blank period to secure a certain sensing period regardless of a variation of the frame frequency, thereby increasing the reliability of sensing. The timing controller 11 may arrange the first vertical blank period prior to the vertical active period so that the sensing driving operation is first performed prior to a display driving operation in the same frame and may arrange the second vertical blank period irrelevant to the sensing driving operation after the vertical active period where the display operation has been performed, and thus, may solve a problem where a position of a compensation pixel is recognized by a user due to a luminance deviation between the compensation pixel and a non-compensation pixel.

To this end, the timing controller 11 may receive the input image data IDATA and the input data enable signal I-DE and may modulate the input image data IDATA and the input data enable signal I-DE so as to be delayed by the first vertical blank period, so that the first vertical blank period and the second vertical blank period are arranged with the vertical active period therebetween in a one-frame period. That is, the timing controller 11 may delay the input image data IDATA and the input data enable signal I-DE during a certain period, and then, may generate a delay data enable signal and delay image data DDATA. A modulation operation of the timing controller 11 will be described below with reference to FIGS. 11 to 13.

In the display operation, the timing controller 11 may generate a first data control signal DDC for controlling an operation timing of the data IC 12 and a first gate control signal GDC for controlling an operation timing of the gate driver 13, on the basis of a plurality of timing signals such as the vertical synchronization signal Vsync and the delay data enable signal. In the sensing driving operation, the timing controller 11 may generate a second data control signal DDC for controlling the operation timing of the data IC 12 and a second gate control signal GDC for controlling the operation timing of the gate driver 13, on the basis of the timing signals such as the vertical synchronization signal Vsync and the input data enable signal I-DE. Also, the timing controller 11 may further set a luminance recovery driving operation independently from the sensing driving operation and the display driving operation, and in the luminance recovery driving operation, the timing controller 11 may generate a third data control signal DDC for controlling the operation timing of the data IC 12 and a third gate control signal GDC for controlling the operation timing of the gate driver 13, on the basis of the timing signals such as the vertical synchronization signal Vsync and the input data enable signal I-DE.

The timing controller 11 may individually control a display driving timing, a sensing driving timing, and a luminance recovery driving timing of each of the pixel group lines of the display panel 10 on the basis of the gate control signals GDC and the data control signals DDC, and thus, an electrical characteristic of each of the pixels PXL may be sensed by pixel group line units in real time in the middle of displaying an image.

Here, the display driving operation may denote a driving operation of supplying the pixel group lines with a first data voltage (hereinafter referred to as a display data voltage) for the display driving operation in one frame on the basis of a line progressive scheme to allow the display panel 10 to reproduce an input image. The sensing driving operation may denote a driving operation of applying a second data voltage (hereinafter referred to as a sensing data voltage) to the pixels PXL provided in a specific pixel group line (hereinafter referred to as a sensing pixel group line) to sense an electrical characteristic of corresponding pixels PXL. Also, the luminance recovery driving operation may be a driving operation of compensating for luminance loss caused by the sensing operation by applying a third data voltage (hereinafter referred to as a luminance recovery data voltage), to which a compensation gain is applied, to pixels PXL of the sensing pixel group line on which the sensing operation has been completed. The third data voltage may be a voltage which is obtained by applying the compensation gain to the first data voltage, and thus, may differ from the first data voltage.

The timing controller 11 may control an operation of each of the panel driving circuits 121 and 13 so that the display driving operation is performed in the vertical active period of one frame and may control an operation of each of the sensing circuit 122 and the panel driving circuits 121 and 13 so that the sensing operation is performed in the first vertical blank period prior to the vertical active period of the one frame. Also, the timing controller 11 may control an operation of each of the panel driving circuits 121 and 13 so that the luminance recovery driving operation is performed between an end time of the sensing driving operation and a start time of the display driving operation.

The vertical active period may be a period where the display data voltage is applied to the pixels PXL provided in all pixel group lines. The first vertical blank period may be a period where the supply of the display data voltage stops, and moreover, the first vertical blank period may include a sensing period and may partially include a luminance recovery period. In the sensing period, the sensing data voltage may be applied to the pixels PXL provided in the sensing pixel group line, and in the luminance recovery period succeeding the sensing period, the luminance recovery data voltage may be applied to pixels PXL provided in the sensing pixel group line.

The gate driver 13 may separately generate a display scan signal SCAN, a sensing scan signal, and a luminance recovery scan signal on the basis of control by the timing controller 11.

In order to implement the display driving operation, in the vertical active period, the gate driver 13 may generate the display scan signal SCAN on the basis of the first gate control signal GDC based on the delay data enable signal and may supply the display scan signal SCAN to the gate lines 17 on the basis of the line progressive scheme.

In order to implement the sensing driving operation, in the first vertical blank period prior to the vertical active period, the gate driver 13 may generate the sensing scan signal on the basis of the second gate control signal GDC based on the input data enable signal I-DE and may supply the sensing scan signal to the gate line 17 connected to the sensing pixel group line.

Subsequently, in order to implement the luminance recovery driving operation, the gate driver 13 may generate the luminance recovery scan signal on the basis of the third gate control signal GDC based on the input data enable signal I-DE and may further supply the luminance recovery scan signal to the gate line 17 connected to the sensing pixel group line.

In a case where one pixel group line is sensing-driven at every first vertical blank period, positions of sensing pixel group lines may be randomly distributed based on an operation in a plurality of first vertical blank periods. When the positions of the sensing pixel group lines are randomly distributed, an adverse effect where the positions of the sensing pixel group lines are recognized may be minimized by a visual integral effect.

The gate driver 13 may be provided in a non-display area NA of the display panel 10 on the basis of a gate driver in panel (GIP) type.

The DAC 121 may be connected to the data lines 15. The DAC 121 may separately generate a display data voltage Vdata, a sensing data voltage, and a luminance recovery data voltage on the basis of control by the timing controller 11.

In order to implement the display driving operation, in the vertical active period, the DAC 121 may convert the delay image data DDATA into the display data voltage Vdata on the basis of the first data control signal DDC based on the delay data enable signal and may supply the display data voltage Vdata to the data lines 15 in synchronization with the display scan signal SCAN.

In order to implement the sensing driving operation, in the first vertical blank period prior to the vertical active period, the DAC 121 may generate the sensing data voltage on the basis of the second data control signal DDC based on the input data enable signal I-DE and may supply the sensing data voltage to the data lines 15 in synchronization with the sensing scan signal.

Subsequently, in order to implement the luminance recovery driving operation, the DAC 121 may generate the luminance recovery data voltage on the basis of the third data control signal DDC based on the input data enable signal I-DE and may further supply the luminance recovery data voltage to the data lines 15 in synchronization with the luminance recovery scan signal.

In the sensing driving operation, the sensing circuit 122 may be connected to target pixels PXL of the sensing pixel group line through the readout lines 16. In the sensing period included in the first vertical blank period, the sensing circuit 122 may sense an electrical characteristic of a driving TFT DT, included in each of the target pixels PXL, through the readout lines 16. The sensing circuit 122 may be implemented as a voltage sensing type, or may be implemented as a current sensing type.

A voltage sensing type sensing circuit 122 of the sensing circuit 122 may include a sampling circuit and an analog-to-digital converter (ADC). The sampling circuit may directly sample a specific node voltage of the target pixel PXL stored in a parasitic capacitor of the readout line 16. The ADC may convert an analog voltage, obtained through sampling by the sampling circuit, into a digital sensing value and may transfer the digital sensing value to the timing controller 11.

A current sensing type sensing circuit 122 of the sensing circuit 122 may include a current integrator, a sampling circuit, and an ADC. The current integrator may perform an integral on the pixel current flowing in the target pixel PXL to output a sensing voltage. The sampling circuit may sample the sensing voltage output from the current integrator. The ADC may convert an analog voltage, obtained through sampling by the sampling circuit, into a digital sensing value and may transfer the digital sensing value to the timing controller 11.

An output terminal of the host system 14 may be connected to the timing controller 11 through various interface circuits. The host system 14 may vary the frame frequency on the basis of an input image and may transfer the vertical synchronization signal Vsync, the input data enable signal I-DE, and the input image data IDATA to the timing controller 11 in synchronization with the variable frame frequency. The host system 14 may be mounted on a system board. The host system 14 may include an input unit which receives a user command/data, a main power unit which generates a main power, a variable refresh rate (VRR) control circuit which varies the frame frequency on the basis of the input image, and an output terminal which outputs a transfer signal. The host system 14 may be implemented with an application processor, a personal computer (PC), a set-top box, or a graphics processor unit, but is not limited thereto.

Figure 4:
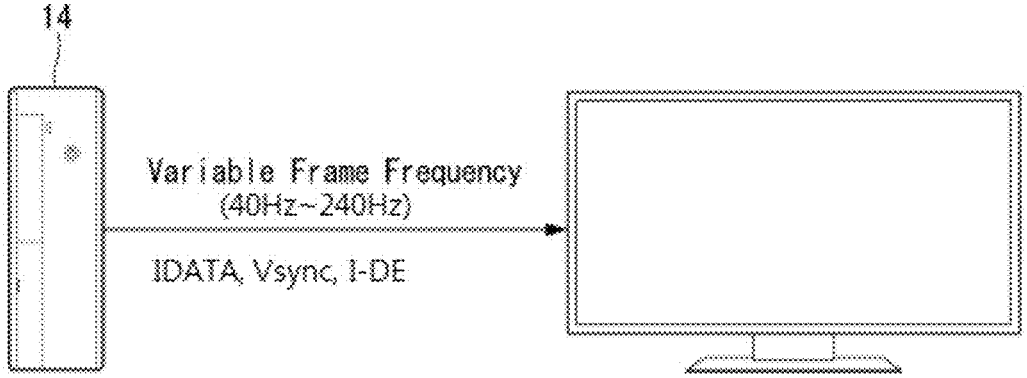
FIG. 4 is a diagram illustrating an example where signals based on a variable frame frequency are transferred and received between a host system and a timing controller.
Figure 5:
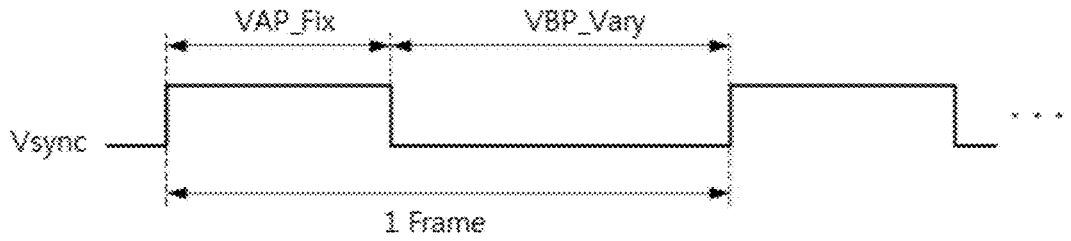
FIGS. 5 and 6 are diagrams for describing variable refresh rate (VRR) technology for varying a frame frequency on the basis of an input image.
Figure 6:
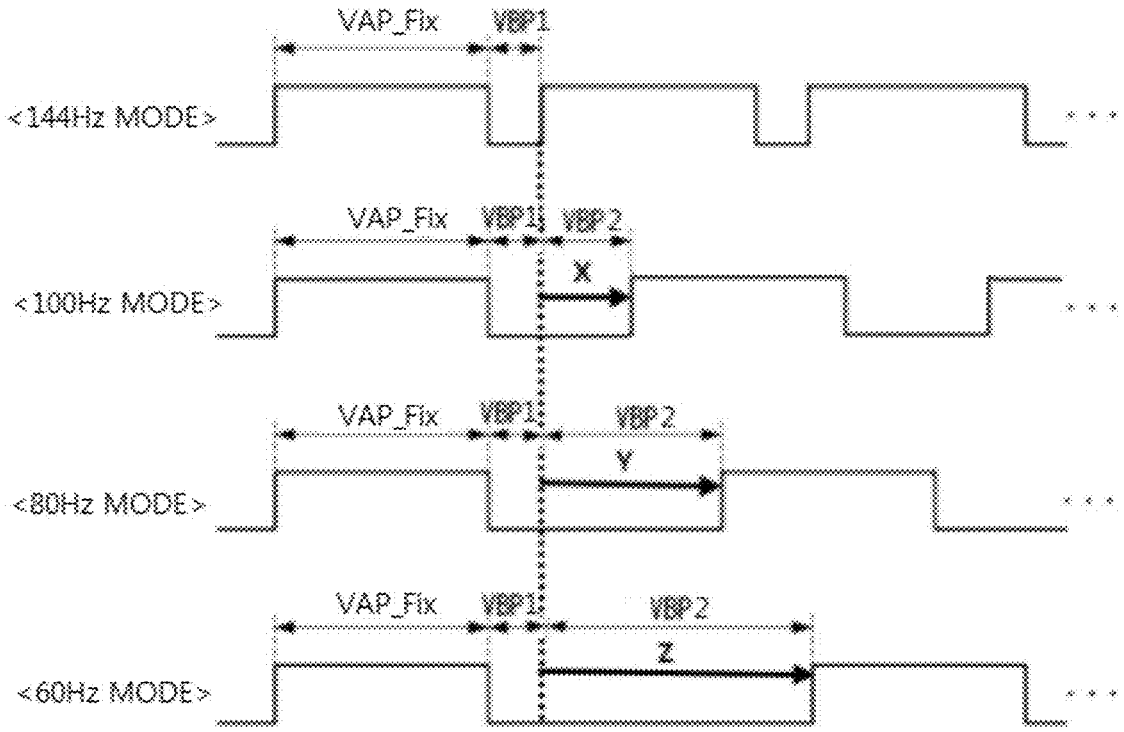

FIG. 4 is a diagram illustrating an example where signals based on a variable frame frequency are transferred and received between a host system and a timing controller. FIGS. 5 and 6 are diagrams for describing VRR technology for varying a frame frequency on the basis of an input image.

Referring to FIG. 4, the host system 14 may use VRR technology based on video electronic standards association (VESA) and may include a VRR control circuit. The host system 14 may vary the frame frequency on the basis of an input image. The VRR technology may vary the frame frequency on the basis of the input image, and thus, may prevent a tearing phenomenon and may provide a smoother image screen.

The VRR control circuit included in the host system 14 may detect a variation amount of the input image by frame units and may vary the frame frequency on the basis of an image variation amount, thereby solving problems such as screen disconnection, screen shaking, and input delay caused by a rapid image variation. When the image variation amount is relatively high, the VRR control circuit may increase the frame frequency within a predetermined variable frame frequency range. On the other hand, when the image variation amount is relatively low, the VRR control circuit may decrease the frame frequency within the predetermined variable frame frequency range. For example, the VRR control circuit may adjust the frame frequency on the basis of the image variation amount within a frequency of about 40 Hz to about 240 Hz. A range of the variable frame frequency may be differently set based on a model and spec.

The host system 14 may fix a length of a vertical active period VAP as in FIG. 5 and may adjust a length of a vertical blank period VBP on the basis of the image variation amount, thereby varying the frame frequency. In order to realize smooth signal matching with the timing controller 11, a length of the vertical active period VAP may be set to be fixed based on a highest frame frequency within a predetermined variable frame frequency range.

In order to adjust a length of the vertical blank period VBP, the host system 14 may set and fix a first vertical blank period VBP1 on the basis of a highest frame frequency (for example, 240 Hz) and may adjust a length of a second vertical blank period VBP2 to increase from the first vertical blank period VBP1 on the basis of a reduction in the frame frequency.

For example, the host system 14 may set the vertical blank period VBP so that the vertical blank period VBP includes only the first vertical blank period VBP1, so as to implement a 144 Hz mode as in FIG. 6. The host system 14 may set the vertical blank period VBP so that the vertical blank period VBP includes the first vertical blank period VBP1 and the second vertical blank period VBP2 increased by an "X" period from the first vertical blank period VBP1, so as to implement the 100 Hz mode. The host system 14 may set the vertical blank period VBP so that the vertical blank period VBP includes the first vertical blank period VBP1 and the second vertical blank period VBP2 increased by a "Y" period (Y>X) from the first vertical blank period VBP1, so as to implement an 80 Hz mode. Also, the host system 14 may set the vertical blank period VBP so that the vertical blank period VBP includes the first vertical blank period VBP1 and the second vertical blank period VBP2 increased by a "Z" period (Z>Y) from the first vertical blank period VBP1, so as to implement a 60 Hz mode.

FIGS. 7 to 9B are diagrams for describing sensing pixel group line compensation (SLC) technology for compensating for a length deviation of a luminance recovery period with respect to a position of a sensing pixel group line, in external compensation technology.

The SLC technology may be implemented with a simple logic in a fixed frame frequency environment (i.e., an environment where the frame frequency is fixed regardless of a variation amount of an input image).

For example, a case will be described where, when a frame frequency environment is a fixed frame frequency environment of X Hz as in FIG. 7, pixels of an m-$1^{th}$ pixel group line (i.e., pixels of a pixel group line supplied with SCAN(m-1)) are sensed in a vertical blank period VBP of an N−$1^{th}$ frame, and pixels of a fourth pixel group line (i.e., pixels of a pixel group line supplied with SCAN(4)) are sensed in a vertical blank period VBP of an $N^{th}$ frame (X Hz).

In a first display period DTME1, the pixels of the m-$1^{th}$ pixel group line may be charged with a display data voltage (WT-DIS operation) on the basis of an m-$1^{th}$ display scan signal SCAN(m-1), and then, may maintain an emission state based on the display data voltage (HLD-DIS operation) for the other time of the first display period DTME1. The first display period DTME1 may partially overlap a vertical active period VAP and a vertical blank period VBP of the N−$1^{th}$ frame.

In a sensing period STME succeeding the first display period DTME1, the pixels of the m-$1^{th}$ pixel group line may be charged with a sensing data voltage (WT-SEN operation) on the basis of a sensing scan signal, and then, may be to be sensed in a non-emission state. The sensing period STME may be in the vertical blank period VBP of the N−$1^{th}$ frame.

In a first luminance recovery period RTME1 succeeding the sensing period STME, the pixels of the m-$1^{th}$ pixel group line may be charged with a luminance recovery data voltage (WT-RCV operation) on the basis of a luminance recovery scan signal, and then, may maintain an emission state based on the luminance recovery data voltage (HLD-RCV operation) for the other time of the first luminance recovery period RTME1. The first luminance recovery period RTME1 may partially overlap the vertical blank period VBP of the N−$1^{th}$ frame and a vertical active period VAP of the $N^{th}$ frame.

In a second display period DTME2, the pixels of the fourth pixel group line may be charged with a display data voltage (WT-DIS operation) on the basis of a fourth display scan signal SCAN(4), and then, may maintain an emission state based on the display data voltage (HLD-DIS operation) for the other time of the second display period DTME2. The second display period DTME2 may partially overlap the vertical active period VAP and the vertical blank period VBP of the $N^{th}$ frame.

In a sensing period STME succeeding the second display period DTME2, the pixels of the fourth pixel group line may be charged with the sensing data voltage (WT-SEN operation) on the basis of the sensing scan signal, and then, may be to be sensed in a non-emission state. The sensing period STME may be in the vertical blank period VBP of the $N^{th}$ frame.

In a second luminance recovery period RTME2 succeeding the sensing period STME, the pixels of the fourth pixel group line may be charged with the luminance recovery data voltage (WT-RCV operation) on the basis of the luminance recovery scan signal, and then, may maintain an emission state based on the luminance recovery data voltage (HLD-RCV operation) for the other time of the second luminance recovery period RTME2. The second luminance recovery period RTME2 may partially overlap the vertical blank period VBP of the $N^{th}$ frame and a vertical active period VAP of an N+$1^{th}$ frame.

Because a frame frequency environment is the fixed frame frequency environment, a length of the vertical blank period VBP of the $N-1^{th}$ frame may be the same as that of the vertical blank period VBP of the $N^{th}$ frame. Also, in each of the vertical blank period VBP of the $N-1^{th}$ frame and the vertical blank period VBP of the $N^{th}$ frame, the sensing period STME may have the same time length. Also, because the frame frequency environment is the fixed frame frequency environment, a length of one frame needed for a display driving operation, a sensing driving operation, and a luminance recovery driving operation performed on the pixels of the m-$1^{th}$ pixel group line may be the same as that of one frame needed for a display driving operation, a sensing driving operation, and a luminance recovery driving operation performed on the pixels of the fourth pixel group line.

In the vertical blank period VBP of the $N-1^{th}$ frame, the m-$1^{th}$ display scan signal SCAN(m-1) may have a phase which is earlier than that of the fourth display scan signal SCAN(4). Therefore, with respect to the pixels of the m-$1^{th}$ pixel group line, the first display period DTME1 may be relatively short, and the first luminance recovery period RTME1 may be relatively long.

In the vertical blank period VBP of the $N^{th}$ frame, the fourth display scan signal SCAN(4) may have a phase which is later than that of the m-$1^{th}$ display scan signal SCAN(m-1). Therefore, with respect to the pixels of the fourth pixel group line, the second display period DTME2 may be relatively long, and the second luminance recovery period RTME2 may be relatively short.

Figure 7:
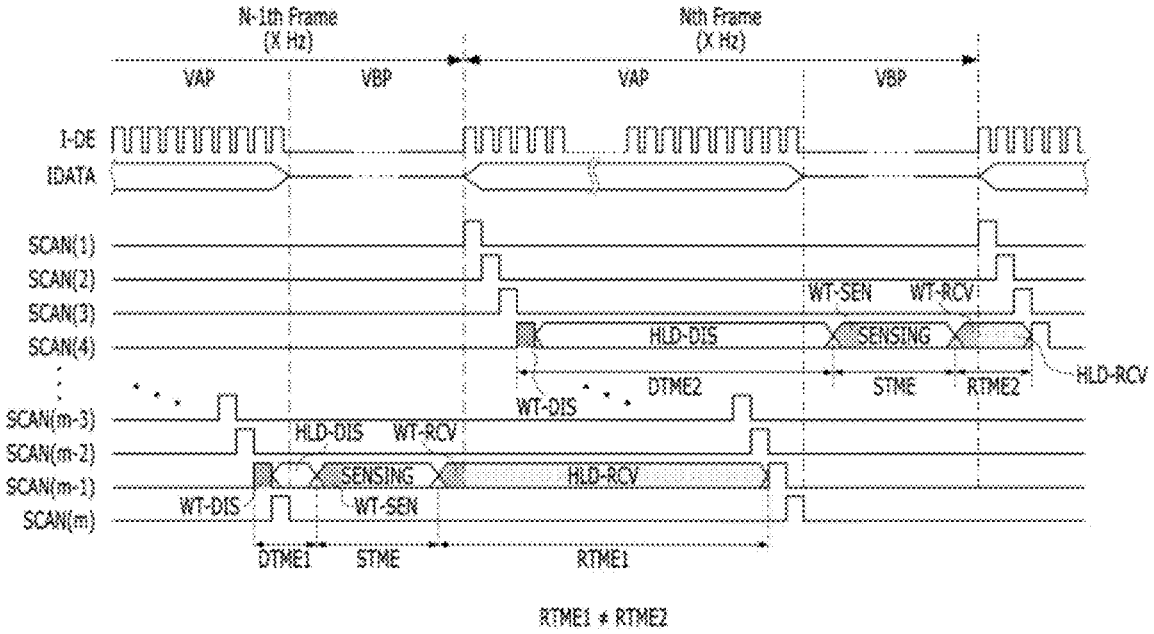
FIGS. 7 and 8 are diagrams for describing an example where a length of a luminance recovery period varies based on a position of a pixel group line including a sensing pixel in external compensation technology.
Figure 8:
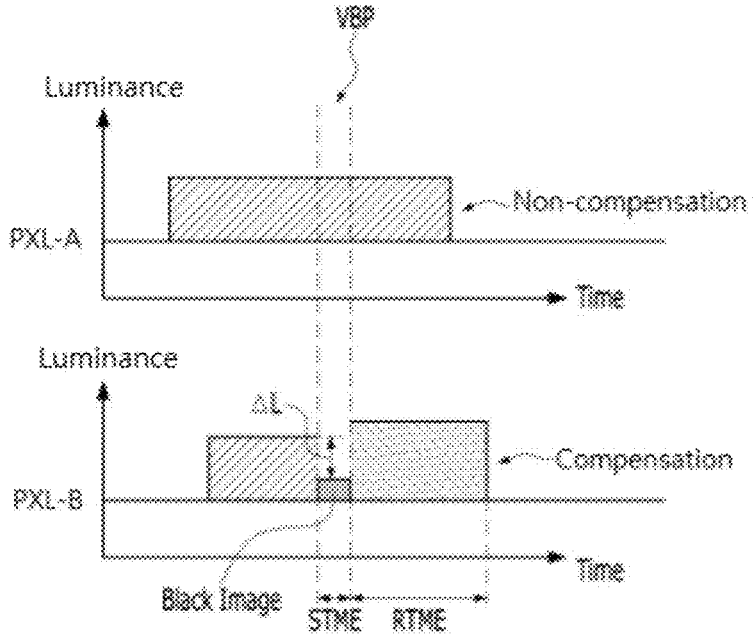

However, as in FIG. 8, in a case where all pixels in one screen display an image having the same brightness, pixels of a sensing pixel group line PXL-B may not emit light during a sensing period STME in a vertical blank period VBP, and thus, may realize luminance which is "ΔL" lower than pixels of a sensing pixel group line PXL-A. The sensing pixel group line PXL-B may be the m-$1^{th}$ and fourth pixel group lines in the embodiment of FIG. 7.

In the embodiment of FIG. 7, the first luminance recovery period RTME1 and the second luminance recovery period RTME2 may be for compensating for luminance loss. The first luminance recovery period RTME1 and the second luminance recovery period RTME2 may have different time lengths, and thus, a compensation gain may be differentially applied thereto. When the compensation gain is applied, luminance in a luminance recovery period may be relatively higher than a display period as in FIG. 8, and thus, all pixels in one screen may substantially realize the same luminance.

A magnitude of the compensation gain and a time length of the luminance recovery period may have an inversely proportional relationship therebetween. All sensing pixel group lines may have a sensing period having the same length regardless of relative positions of the sensing pixel group lines, and thus, may have the same luminance loss. However, the sensing pixel group lines may have luminance recovery periods having different lengths on the basis of relative positions therebetween, and thus, the magnitude of the compensation gain for compensating for luminance loss may be differently applied to the sensing pixel group lines.

Figure 9A:
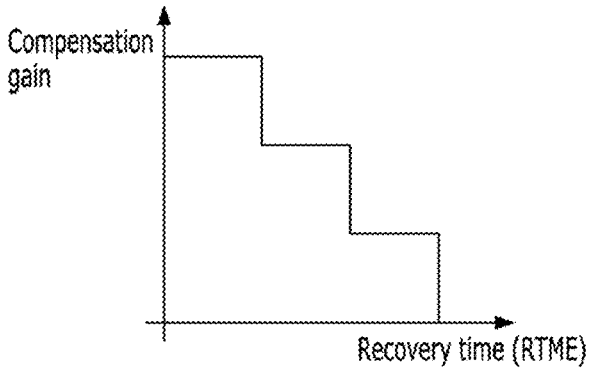
FIGS. 9A and 9B are diagrams illustrating examples where a compensation gain for compensating for luminance loss based on sensing is differently set based on a length of a luminance recovery period.

The magnitude of the compensation gain, as in FIG. 9A, may be differentially set for each of luminance recovery block periods grouped based on a certain time size. Therefore, a compensation gain logic may be simplified, and a compensation processing speed may increase.

Figure 9B:
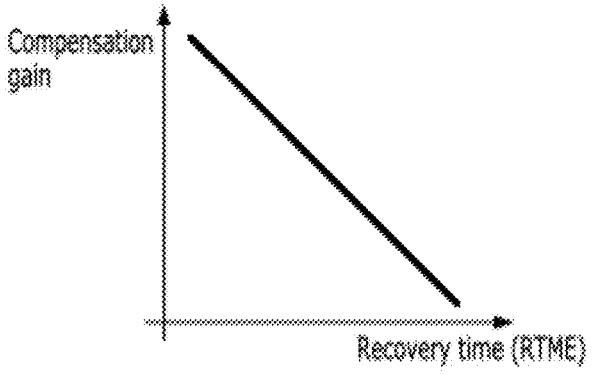

The magnitude of the compensation gain, as in FIG. 9B, may be differentially set for each luminance recovery period which varies for each sensing pixel group line. Therefore, the accuracy of compensation may increase.

A correction operation performed on image data on the basis of the compensation gain may be performed by the timing controller. The timing controller may further include an SLC compensation logic circuit for applying the compensation gain to image data which is to be applied to a pixel of a sensing pixel group line. The SLC technology, described above with reference to FIGS. 7 to 9B, may be implemented with a simple logic in a fixed frame frequency environment. A position of a sensing pixel group line may be predetermined for each frame, but because a frame frequency environment is a fixed frame frequency environment, a length of a luminance recovery period corresponding to the same sensing pixel group line may not be changed despite a frame being changed. That is, because the frame frequency environment is the fixed frame frequency environment, luminance recovery periods may be previously mapped to positions of sensing pixel group lines to have different fixed lengths. Also, the compensation gain may be previously and differentially set for luminance recovery periods having different fixed lengths.

Figure 10:
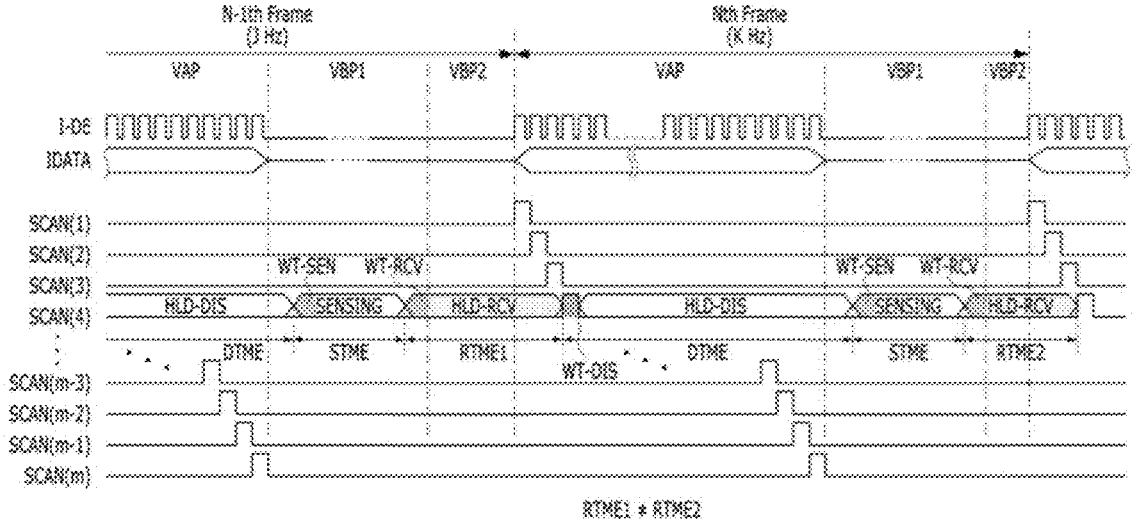
FIG. 10 is a diagram illustrating a comparative example of the present disclosure where a length of a luminance recovery period corresponding to the same sensing pixel group line varies based on a variation of a frame frequency.

FIG. 10 is a diagram illustrating a comparative example of the present disclosure where a length of a luminance recovery period corresponding to the same sensing pixel group line varies based on a variation of a frame frequency.

It may be difficult to apply the SLC technology, described above with reference to FIGS. 9A and 9B, to a variable frame frequency environment as in FIG. 10. This is because a length of a luminance recovery period corresponding to the same sensing pixel group line varies based on a variation of a frame frequency.

To provide an additional description, it may be assumed that pixels of a fourth pixel group line (i.e., pixels of a pixel group line supplied with SCAN(4)) are successively sensed in each of an $N-1^{th}$ frame having a frame frequency of J Hz and an $N^{th}$ frame having a frame frequency of K Hz which is higher than J Hz.

As described above with reference to FIGS. 5 and 6, in the variable frame frequency environment, a time length of each of a vertical active period VAP and a first vertical blank period VBP1 may be identically set in the $N-1^{th}$ and $N^{th}$ frames regardless of a variation of a frame frequency. Accordingly, a length of a sensing period STME included in the first vertical blank period VBP1 may be identically set in the $N-1^{th}$ and $N^{th}$ frames.

On the other hand, the second vertical blank period VBP2 may be set to be longer in the $N-1^{th}$ frame having a relatively lower frame frequency than the $N^{th}$ frame. The second vertical blank period VBP2 may determine a length of a luminance recovery period in the $N-1^{th}$ and $N^{th}$ frames. Accordingly, with respect to the same fourth pixel group line, a first luminance recovery period RTME1 of the $N-1^{th}$ frame may be longer than a second luminance recovery period RTME2 of the $N^{th}$ frame.

In the variable frame frequency environment where a length of a luminance recovery period varies more based on a frame frequency as well as a relative position of a sensing pixel group line, it is unable to predict the length variation of the luminance recovery period based on a variation of the frame frequency, and due to this, it is impossible to apply the SLC technology. This will be additionally described below.

The timing controller may determine a frame frequency of each frame with reference to the input data enable signal I-DE transferred from the host system, instead of separately receiving information about a variable frame frequency from the host system. In a specific frame, the timing controller may determine a transition period of the input data enable signal I-DE (i.e., a period where there are pulses generated alternately between a logic low voltage and a logic high voltage) as a vertical active period VAP of a corresponding frame and may determine a non-transition period of the input data enable signal I-DE (i.e., a period where only the logic low voltage is maintained without the pulses) as a vertical blank period (including a first vertical blank period VBP1 and a second vertical blank period VBP2) of a corresponding frame. Therefore, the timing controller may not know a second vertical blank period VBP2 of the $N-1^{th}$ frame until a first pulse of the input data enable signal I-DE starts to rise in the $N^{th}$ frame, and moreover, may not know a second vertical blank period VBP2 of the $N^{th}$ frame until a first pulse of the input data enable signal I-DE starts to rise in the $N+1^{th}$ frame. In other words, the timing controller may not predict a length variation of the first luminance recovery period RTME1 based on a frame frequency (J Hz) of the $N-1^{th}$ frame, and due to this, it may be difficult to apply an appropriate compensation gain to the first luminance recovery period RTME1. Likewise, the timing controller may not predict a length variation of the second luminance recovery period RTME2 based on a frame frequency (K Hz) of the $N^{th}$ frame, and due to this, it may be difficult to apply an appropriate compensation gain to the second luminance recovery period RTME2.

When a length deviation of the first and second luminance recovery periods RTME1 and RTME2 corresponding to the same sensing pixel group line is not compensated for based on an appropriate compensation gain, the sensing pixel group line may be recognized as line dim. The reason of such a problem is because a first vertical blank period VBP1 having a fixed length and a second vertical blank period VBP2 having a length varying based on a frame frequency are successively arranged in the same frame based on a variable frame frequency.

Figure 11:
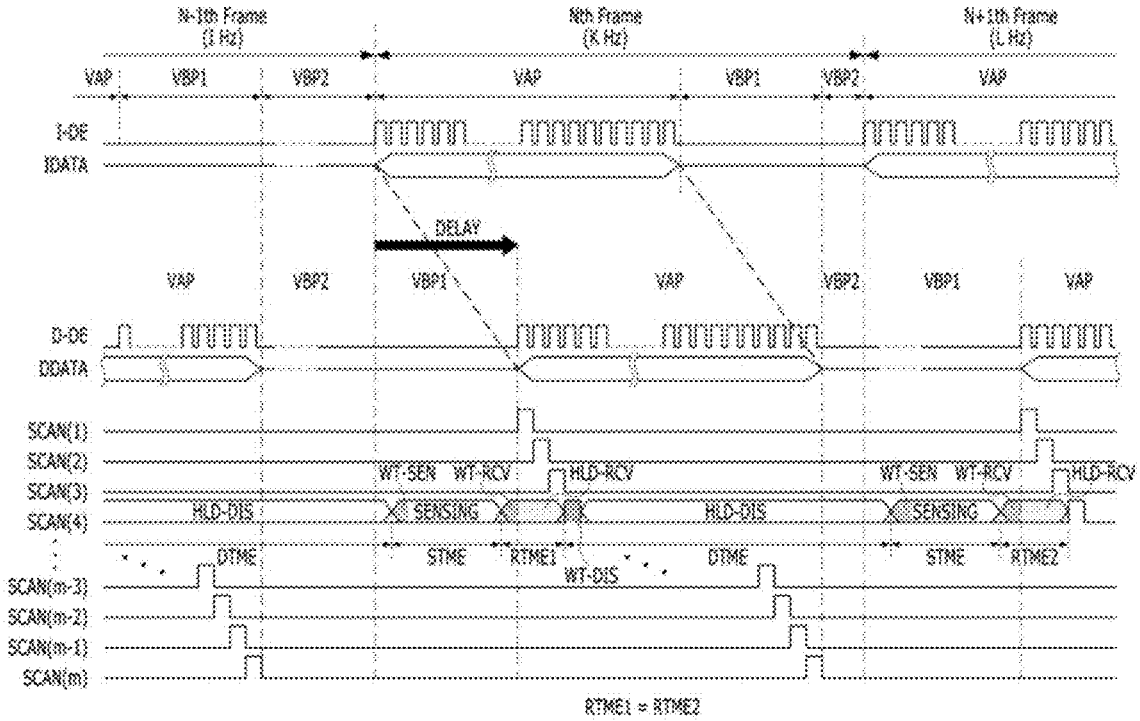
FIG. 11 is a diagram illustrating an embodiment of the present disclosure where a length of a luminance recovery period corresponding to the same sensing pixel group line is constant, regardless of a variation of a frame frequency.
Figure 12:
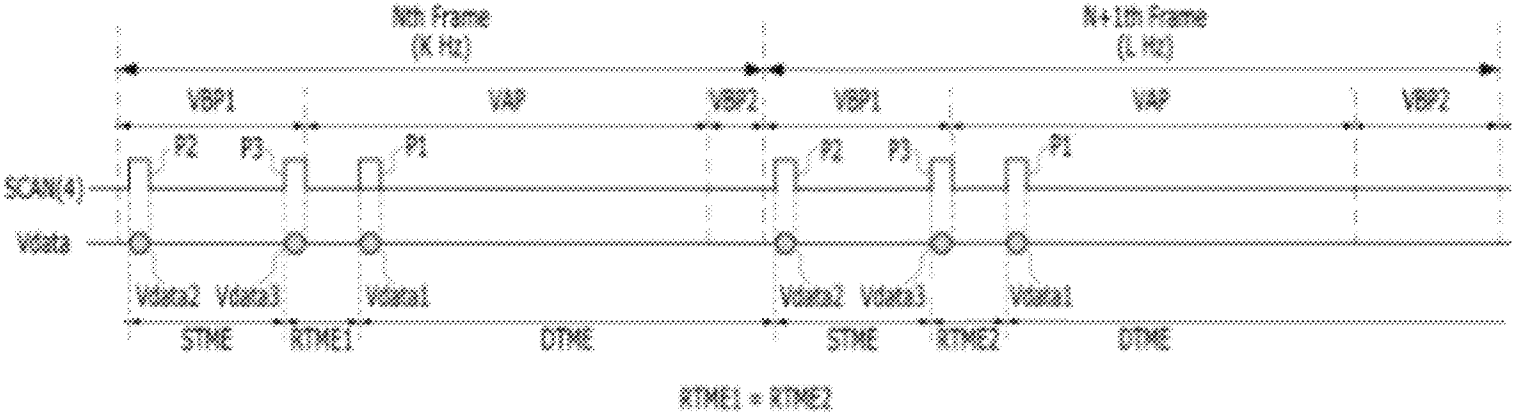
FIG. 12 shows a waveform of a data voltage and a scan signal applied to the sensing pixel group line of FIG. 11.

FIG. 11 is a diagram illustrating an embodiment of the present disclosure where a length of a luminance recovery period corresponding to the same sensing pixel group line is constant, regardless of a variation of a frame frequency. FIG. 12 shows a waveform of a data voltage and a scan signal applied to the sensing pixel group line of FIG. 11.

Referring to FIGS. 11 and 12, the electroluminescence display apparatus according to an embodiment of the present disclosure may be for disabling a user to recognize a position of a compensation pixel even when a frame frequency varies based on an input image in a process of compensating for an electrical characteristic deviation between pixels on the basis of an external compensation method. In other words, in the electroluminescence display apparatus according to an embodiment of the present disclosure, in a case where the SLC technology is applied in the variable frame frequency environment, a length of a luminance recovery period corresponding to the same pixel group line may be constant, regardless of a variation of a frame frequency, and thus, a sensing pixel group line may be prevented from being recognized as line dim.

As in FIG. 11, in a variable frame frequency environment where $N-1^{th}$ to $N+1^{th}$ frames have different frame frequencies (for example, "I Hz", "K Hz", and "L Hz"), the timing controller may set a length of a first luminance recovery period RTME1 in an $N^{th}$ frame and a length of a second luminance recovery period RTME2 in an $N+1^{th}$ frame so as to be constant regardless of a variation of a frame frequency.

In the same frame, based on the delay of input signals I-DE and IDATA, the timing controller may arrange a first vertical blank period VBP1 for a sensing driving operation and a luminance recovery driving operation before a second vertical blank period VBP2 maintaining a display state and may arrange the second vertical blank period VBP2 maintaining the display state after a vertical active period VAP. In other words, when a one-frame configuration arranged in the order of "VAP-VBP1-VBP2" is changed to the order of "VBP1-VAP-VBP2" on the basis of the delay of the input signals I-DE and IDATA, a length of a luminance recovery period corresponding to the same pixel group line may be the same in the $N^{th}$ frame and the $N+1^{th}$ frame. This is because a length of the first luminance recovery period RTME1 in the $N^{th}$ frame and a length of the second luminance recovery period RTME2 in the $N+1^{th}$ frame are determined regardless of the second vertical blank period VBP2 where a length thereof varies based on a rate of a frame frequency.

To this end, an electroluminescence display apparatus according to an embodiment of the present disclosure may include a display panel (10 of FIG. 1), a sensing circuit (122 of FIG. 1), and a plurality of panel driving circuits (121 and 13 of FIG. 1), and moreover, may further include a host system (14 of FIG. 1) and a timing controller (11 of FIG. 1).

In the $N^{th}$ frame, an operation of an electroluminescence display apparatus associated with the one-frame configuration change ("VBP1-VAP-VBP2") will be briefly described below.

The host system 14 may output input image data IDATA and an input data enable signal I-DE of the $N^{th}$ frame in synchronization with a frame frequency having K Hz.

The timing controller 11 may receive the input image data IDATA and the input data enable signal I-DE of the $N^{th}$ frame from the host system 14. The timing controller 11 may modulate the input image data IDATA and the input data enable signal I-DE of the $N^{th}$ frame. In other words, the timing controller 11 may delay the input image data IDATA of the $N^{th}$ frame by a first vertical blank period VBP1 and may delay the input data enable signal I-DE of the $N^{th}$ frame by the first vertical blank period VBP1. A length of the first vertical blank period VBP1 may be set based on a highest frame frequency within a predetermined range of a variable frame frequency and may be fixed regardless of a variation of a frame frequency.

In a one-frame period corresponding to the $N^{th}$ frame, based on the delay of input signals I-DE and IDATA of the $N^{th}$ frame, the timing controller 11 may rearrange the first vertical blank period VBP1 before the vertical active period VAP and may rearrange the second vertical blank period VBP2 after the vertical active period VAP. A length of the second vertical blank period VBP2 may vary based on a variation of a frame frequency. In a case where the range of the variable frame frequency includes a first frame frequency which is lowest and a second frame frequency which is highest, a length of the second vertical blank period VBP2 may be longest in the first frame frequency and may be shortest in the second frame frequency.

The timing controller 11 may generate a first gate control signal GDC and a first data control signal DDC on the basis of a delay data enable signal D-DE of the $N^{th}$ frame. The timing controller 11 may supply the panel driving circuits 121 and 13 with delay image data DDATA, the first gate control signal GDC, and the first data control signal DDC during the vertical active period VAP of the $N^{th}$ frame.

The timing controller 11 may generate a second gate control signal GDC, a second data control signal DDC, a third gate control signal GDC, and a third data control signal DDC on the basis of the delay data enable signal D-DE of the $N^{th}$ frame. The timing controller 11 may supply the panel driving circuits 121 and 13 with the second gate control signal GDC, the second data control signal DDC, the third gate control signal GDC, and the third data control signal DDC during the first vertical blank period VBP1 of the $N^{th}$ frame.

The panel driving circuits 121 and 13 may drive pixels of a fourth pixel group line (pixels supplied with SCAN(4)) (hereinafter referred to as target pixels) designated as a sensing pixel group line in the $N^{th}$ frame, on the basis of control by the timing controller 11.

In the vertical active period VAP of the $N^{th}$ frame, the panel driving circuits 121 and 13 may generate a first data voltage Vdata1 for a display driving operation and a display scan signal P1 synchronized with the first data voltage Vdata1 on the basis of the first gate control signal GDC and the first data control signal DDC. In the vertical active period VAP of the $N^{th}$ frame, the panel driving circuits 121 and 13 may apply the first data voltage Vdata1 and the display scan signal P1 to target pixels (WT-DIS operation) to display-drive the target pixels (HLD-DIS operation). The WT-DIS operation may be performed in a display period DTME included in the vertical active period VAP of the $N^{th}$ frame, and the HLD-DIS operation may be performed in the vertical active period VAP and the second vertical blank period VBP2 of the $N^{th}$ frame.

In the first vertical blank period VBP1 prior to the vertical active period VAP of the $N^{th}$ frame, the panel driving circuits 121 and 13 may generate a second data voltage Vdata2 for a sensing driving operation and a sensing scan signal P2 synchronized with the second data voltage Vdata2 on the basis of the second gate control signal GDC and the second data control signal DDC. In the first vertical blank period VBP1 of the $N^{th}$ frame, the panel driving circuits 121 and 13 may apply the second data voltage Vdata2 and the sensing scan signal P2 to the target pixels (WT-SEN operation) to sensing-drive the target pixels. In a sensing driving operation, a plurality of driving elements included in the target pixels may operate based on the second data voltage Vdata2, and a plurality of non-emission elements included in the target pixels may not emit light. Such a WT-SEN operation may be performed in a sensing period STME included in the first vertical blank period VBP1.

In the sensing period STME, the sensing circuit 122 may sense an electrical characteristic (for example, a threshold voltage or electron mobility) of the driving elements included in the target pixels.

The panel driving circuits 121 and 13 may generate a third data voltage Vdata3 for a luminance recovery driving operation and a luminance recovery scan signal P3 synchronized with the third data voltage Vdata3 on the basis of the third gate control signal GDC and the third data control signal DDC in a luminance recovery period RTME of the $N^{th}$ frame which is between an end time of the sensing period STME and a generating time of the display scan signal P1. The third data voltage Vdata3 for the luminance recovery driving operation may be a data voltage to which a compensation gain is applied for compensating for luminance loss caused by non-emission during the sensing period STME. As in FIGS. 9A and 9B, the compensation gain may be set to be highest with respect to a pixel group line (for example, a pixel group line supplied with SCAN(1) in the $N^{th}$ frame) where a length of the luminance recovery period RTME is shortest and may be set to be lowest with respect to a pixel group line (for example, a pixel group line supplied with SCAN(m) in the $N^{th}$ frame) where a length of the luminance recovery period RTME is longest. The panel driving circuits 121 and 13 may supply the target pixels with the third data voltage Vdata3 with the compensation gain applied thereto and the luminance recovery scan signal P3 in the luminance recovery period RTME of the $N^{th}$ frame (WT-RCV operation) to luminance-recovery-drive the target pixels (HLD-RCV operation). Such a WT-RCV operation may be performed in the first vertical blank period VBP1 of the $N^{th}$ frame, and the HLD-RCV operation may be performed until the display scan signal P1 is generated in the vertical active period VAP of the $N^{th}$ frame.

The technical spirit of the present embodiment may be expressed as in FIG. 12.

In FIG. 12, "K Hz" of an $N^{th}$ frame may be a frame frequency which is relatively higher than "L Hz" of an $N+1^{th}$ frame.

Referring to FIG. 12, a gate driver (13 of FIG. 1) may sequentially output a first scan signal (SCAN, P2) synchronized with a sensing data voltage Vdata2, a second scan signal (SCAN, P3) synchronized with a luminance recovery data voltage Vdata3, and a third scan signal (SCAN, P1), synchronized with a display data voltage Vdata1, to the same gate line connected to one pixel in the same frame. Here, one pixel may be driven in a variable frame frequency environment, and for example, may be driven at a first frame frequency (K Hz) in a first frame ($N^{th}$ Frame) and may be driven at a lower second frame frequency (L Hz) than the first frame frequency (K Hz) in a second frame ($N+1^{th}$ Frame).

Based on the delay of input signals I-DE and IDATA described above, an interval (i.e., a luminance recovery period) between a rising edge of the second scan signal (SCAN, P3) and a rising edge of the third scan signal (SCAN, P1) may be the same in the first frame and the second frame. In other words, the luminance recovery period may be fixed regardless of a rate of a frame frequency.

To this end, the first scan signal (SCAN, P2) and the second scan signal (SCAN, P3) may be output in a first vertical blank period VBP1, and third scan signal (SCAN, P1) may be output in a vertical active period VAP which is later in time than the first vertical blank period VBP1. A length of the first vertical blank period VBP1 may be the same in the first frame and the second frame, and a length of the vertical active period VAP may be the same in the first frame and the second frame.

Moreover, a second vertical blank period VBP2 which is later in time than the vertical active period VAP may be in the same frame, and a length of the second vertical blank period VBP2 may differ in the first frame and the second frame. A length of the second vertical blank period VBP2 in the second frame may be longer than that of the second vertical blank period VBP2 in the first frame.

According to the present embodiment, a length of a luminance recovery period RTME1 or RTME2 corresponding to the same pixel group line may be constant regardless of a variation of a frame frequency. This is because the timing controller 11 delays the input signals I-DE and IDATA of each frame, and thus, secures the first vertical blank period VBP1 having a fixed length prior to the vertical active period VAP and implements a sensing driving operation and a luminance recovery driving operation by using the first vertical blank period VBP1.

According to the present embodiment, because a length of a luminance recovery period is merely changed based on the order in which a plurality of display scan signals SCAN(1) to SCAN(m) are supplied and is not changed based on a variation of a frame frequency, the timing controller 11 may apply a compensation gain, which is suitable for a length of the luminance recovery period, to image data and may supply the panel driving circuits 121 and 13 with image data to which the compensation gain is applied. Therefore, the panel driving circuits 121 and 13 may generate a third data voltage with an appropriate compensation gain applied thereto and may apply the generated third data voltage to pixels of a sensing pixel group line, thereby preventing the sensing pixel group line from being recognized as line dim.

Figure 13:
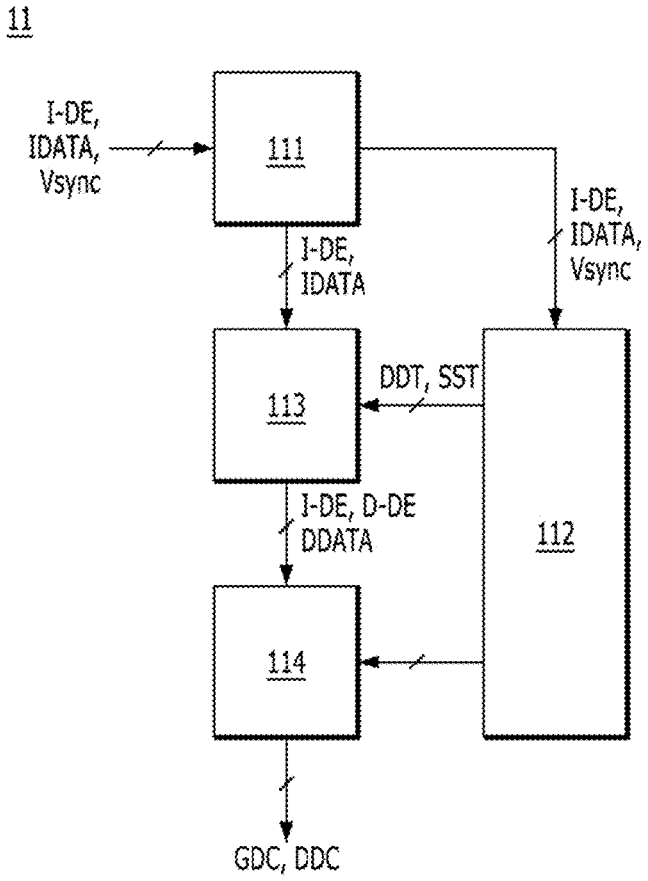
FIG. 13 is a diagram showing an internal configuration of a timing controller for implementing the technical spirit of FIG. 11.

FIG. 13 is a diagram showing an internal configuration of a timing controller 11 for implementing the technical spirit of FIG. 11.

Referring to FIG. 13, the timing controller 11 may include an input circuit 111, a control circuit 112, a delay circuit 113, and a signal output circuit 114.

The input circuit 111 may receive input image data IDATA, an input data enable signal I-DE, and a vertical synchronization signal Vsync of each frame, synchronized with a variable frame frequency, from a host system through a reception terminal.

The control circuit 112 may check a transition and a timing of each of the input signals IDATA, I-DE, and Vsync and may generate a delay control signal DDT and a sensing control signal SST on the basis of the input signals IDATA, I-DE, and Vsync.

The delay circuit 113 may delay the input image data IDATA of each frame by a first vertical blank period having a fixed length on the basis of the delay control signal DDT and may delay a transition period of the input data enable signal I-DE of each frame by the first vertical blank period. The delay circuit 113 may delay the input image data IDATA and the input data enable signal I-DE by using an external memory outside the timing controller 11 to generate a delay image data DDATA and a delay data enable signal D-DE. Also, the delay circuit 113 may supply the signal output circuit 114 with the input data enable signal I-DE, the delay data enable signal D-DE, and the delay image data DDATA through an output terminal.

In each frame, the signal output circuit 114 may generate first to third data control signals DDC and first to third gate control signals GDC for controlling an operation timing of a panel driving circuit so that a sensing driving operation, a luminance recovery driving operation, and a display driving operation are sequentially performed. The signal output circuit 114 may supply the delay image data DDATA to the panel driving circuit along with the first to third data control signals DDC and the first to third gate control signals GDC.

According to the embodiments of the present disclosure, even when a frame frequency varies based on an input image in a process of compensating for an electrical characteristic deviation between pixels on the basis of the external compensation method, a user may not recognize a position of a compensation pixel.

The effects according to the present disclosure are not limited to the above examples, and other various effects may be included in the specification.

While the present disclosure has been particularly shown and described with reference to exemplary embodiments thereof, it will be understood by those of ordinary skill in the art that various changes in form and details may be made therein without departing from the spirit and scope of the present disclosure as defined by the following claims.

What is claimed is:

1. An electroluminescence display apparatus, comprising:

a display panel including a pixel including a driving element and a light emitting device;

a host system configured to output input image data and an input data enable signal in synchronization with a variable frame frequency;

a timing controller configured to arrange a first vertical blank period prior to a vertical active period and a second vertical blank period after the vertical active period in the same frame;

a panel driving circuit supplying the pixel with a first data voltage for a display driving operation and a display scan signal synchronized with the first data voltage in the vertical active period succeeding the first vertical blank period and maintaining the first data voltage in the pixel during the second vertical blank period succeeding the vertical active period; and a sensing circuit sensing an electrical characteristic of the driving element in a sensing period which is in the first vertical blank period, wherein a length of the first vertical blank period is fixed regardless of a variation of a frame frequency, and a length of the second vertical blank period varies based on the variation of the frame frequency, wherein the timing controller delays the input image data and the input data enable signal by the first vertical blank period, wherein a luminance recovery period is between an end time of the sensing period and a generating time of the display scan signal, and the panel driving circuit supplies the pixel with a third data voltage and a luminance recovery scan signal synchronized with the third data voltage in the luminance recovery period, and wherein a length of the luminance recovery period corresponding to the same pixel group line is constant regardless of the variation of the frame frequency.

2. The electroluminescence display apparatus of claim 1, wherein a length of the first vertical blank period is fixedly set based on a highest frame frequency within a predetermined range of a variable frame frequency.

3. The electroluminescence display apparatus of claim 2, wherein the predetermined range of the variable frame frequency comprises a first frame frequency and a second frame frequency which is higher than the first frame frequency, and a length of the second vertical blank period in the first frame frequency is longer than a length of the second vertical blank period in the second frame frequency.

4. The electroluminescence display apparatus of claim 1, wherein the panel driving circuit supplies the pixel with a second data voltage for a sensing driving operation and a sensing scan signal synchronized with the second data voltage in the sensing period, and during the sensing period, the driving element operates based on the second data voltage, and the light emitting device does not emit light.

5. The electroluminescence display apparatus of claim 1, wherein the third data voltage differs from the first data voltage.

6. The electroluminescence display apparatus of claim 5, wherein the third data voltage is generated by applying a compensation gain to the first data voltage.

7. The electroluminescence display apparatus of claim 6, wherein the pixel is included in one of a plurality of pixel group lines to which the display scan signal is sequentially supplied, in the same frame, a length of the luminance recovery period is longer in a second pixel group line than in a first pixel group line, and a supply order of the display scan signal is earlier in the first pixel group line than in the second pixel group line.

8. The electroluminescence display apparatus of claim 7, wherein a compensation gain of when the pixel is included in the first pixel group line is greater than a compensation gain of when the pixel is included in the second pixel group line.

9. The electroluminescence display apparatus of claim 1, wherein the timing controller delays the input image data and the input data enable signal by using a memory.

10. The electroluminescence display apparatus of claim 1, wherein a first gate control signal and a first data control signal, generated based on delay image data obtained through the delay and a delay data enable signal synchronized with the delay image data, are supplied to the panel driving circuit during the vertical active period, and second and third gate control signals and second and third data control signals, generated based on the input data enable signal, are supplied to the panel driving circuit during the first vertical blank period.

11. The electroluminescence display apparatus of claim 10, wherein the panel driving circuit generates the first data voltage and the display scan signal on the basis of the first gate control signal and the first data control signal, generates a second data voltage and a sensing scan signal on the basis of the second gate control signal and the second data control signal, and generates a third data voltage and a luminance recovery scan signal on the basis of the third gate control signal and the third data control signal.

12. An electroluminescence display apparatus comprising:

a display panel including a pixel including a driving element and a light emitting device; and a gate driver sequentially outputting a first scan signal synchronized with a sensing data voltage, a second scan signal synchronized with a luminance recovery data voltage, and a third scan signal, synchronized with a display data voltage, to the same gate line connected to the pixel in the same frame, wherein the pixel is driven at a first frame frequency in a first frame and is driven at a second frame frequency, which is lower than the first frame frequency, in a second frame, and an interval between a rising edge of the second scan signal and a rising edge of the third scan signal is the same in the first frame and the second frame.

13. The electroluminescence display apparatus of claim 12, wherein, in the same frame, the first scan signal and the second scan signal are output in a first vertical blank period, and the third scan signal is output in a vertical active period which is later in time than the first vertical blank period.

14. The electroluminescence display apparatus of claim 13, wherein a length of the first vertical blank period is the same in the first frame and the second frame, and a length of the vertical active period is the same in the first frame and the second frame.

15. The electroluminescence display apparatus of claim 13, wherein a second vertical blank period which is later in time than the vertical active period is in the same frame, and a length of the second vertical blank period differs in the first frame and the second frame.

16. The electroluminescence display apparatus of claim 15, wherein a length of the second vertical blank period in the second frame is longer than a length of the second vertical blank period in the first frame.

17. The electroluminescence display apparatus of claim 12, wherein, in the same frame, the interval varies depending on an order in which the same gate line is supplied, relative to other gate lines, with a combination of the first, second and third scan signals.

* * * * *